US006978955B2

(12) United States Patent
Verhoef et al.

(10) Patent No.: US 6,978,955 B2
(45) Date of Patent: Dec. 27, 2005

(54) MILL BOX FOR MATERIALS GRINDER

(75) Inventors: Gary Verhoef, Pella, IA (US); Frederick H. Lucas, Sigourney, IA (US); Duane A. Harthoorn, Lynnville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 11/015,173

(22) Filed: Dec. 17, 2004
(Under 37 CFR 1.47)

(65) Prior Publication Data

US 2005/0098671 A1 May 12, 2005

Related U.S. Application Data

(62) Division of application No. 10/299,981, filed on Nov. 18, 2002, now Pat. No. 6,843,435.

(51) Int. Cl.[7] ..... B02C 23/02
(52) U.S. Cl. ..... 241/223; 241/186.35
(58) Field of Search ..... 241/186.35, 186.4, 241/222, 223, 285.3

(56) References Cited

U.S. PATENT DOCUMENTS 1,390,548 A * 9/1921 Sharp ..... 241/74
1,786,694 A 12/1930 Borton
4,146,184 A 3/1979 Whitney
4,706,898 A 11/1987 Schonfeld et al.
4,982,904 A 1/1991 Greiner
5,419,502 A 5/1995 Morey
5,529,254 A 6/1996 McIntyre et al.
5,863,003 A 1/1999 Smith
5,881,959 A 3/1999 Hadjinian et al.
5,947,395 A 9/1999 Peterson et al.
5,975,443 A 11/1999 Hundt et al.
6,227,469 B1 5/2001 Daniels, Jr. et al.
6,299,082 B1 10/2001 Smith
6,305,623 B1 10/2001 Sotsky et al.
6,308,905 B1 10/2001 Balvanz et al.
6,474,579 B1 * 11/2002 Bardos et al. ..... 241/88.4

FOREIGN PATENT DOCUMENTS

DE 26 18 254 A1 11/1977

* cited by examiner

*Primary Examiner*—Lowell A. Larson
(74) *Attorney, Agent, or Firm*—Merchant & Gould P.C.

(57) ABSTRACT

A grinder having a grinding structure and a sizing screen is disclosed herein. A top cover covers the grinding structure. The sizing screen can be removed from the grinder by opening the cover, and lifting the sizing screen through the opening left by the cover.

13 Claims, 7 Drawing Sheets

MILL BOX FOR MATERIALS GRINDER

CROSS-REFERENCE TO RELATED APPLICATIONS

This application is a divisional of U.S. application Ser. No. 10/299,981, filed Nov. 18, 2002; now U.S. Pat. No. 6,843,435; which application is incorporated herein by reference.

BACKGROUND OF THE INVENTION

This invention generally relates to grinding machines known as horizontal grinders, and more particularly to the apparatus and methods that enable access to the grinding drum and for changing the sizing screens.

The grinding of a variety of materials can have a desirable effect. For instance grinding of some types of waste results in increased rate of decomposition, which is useful in landfill operations. Ground wood waste results in mulch, which is useful in landscaping applications. Ground asphalt can be reused. Some types of ground shingles can be used in asphalt production. The benefits of and need for such recycling processes continue to grow.

Several types of machines are useful in the variety of grinding applications. One type is particularly adaptable to a wide variety of applications, known as a horizontal grinder. Horizontal grinders typically include a horizontal feed table onto which the materials to be ground can be placed. The feed table is capable of moving the product to a point where a feed roller begins to cooperate with the feed table, generally pressing down on top of the material and being rotationally powered. The material is then forced, by the cooperation of the feed roller and the feed table, into contact with the side of a grinding drum. The grinding drum is as wide as the feed table and rotationally powered on a generally horizontal axis perpendicular to the direction of travel of the feed table.

The grinding drum typically includes hammers or cutters that impact the material as it is fed from the feed roller/feed table. These hammers or cutters tend to propel the material around the axis of rotation of the drum, eventually moving the material past a stationary bar, typically known as an anvil, that is in relatively close proximity to the outer swing diameter of the hammers or cutters. The material will be reduced in size to some extent, as necessary to travel past the anvil. However, further size reduction is typically required.

The additional size reduction is typically accomplished by the interaction of the hammers or cutters with a sizing screen that is also in relatively close proximity to the outer swing diameter of the hammers or cutters. The sizing screen includes holes to allow the material to pass after being reduced to the desired size. It has been found that the shape and size of the holes affects the performance of the machine and the resulting size of the ground material.

The sizing screens are typically provided on the bottom of the grinding drum, so that as material exits the holes in the sizing screen it will fall to a conveyor. A cover is typically provided over the top of the grinding drum to hold material from being thrown out and to carry material not yet sufficiently ground back around.

The grinding drum, sizing screens and cover are mounted in a mill box that provides the support needed for the tremendous loads that can be generated, particularly when grinding the more difficult materials. These tremendous loads result in the sizing screens being constructed of thick metal, and are thus heavy and difficult to handle. The normal operation of the grinding machine results in substantial loading and wear of the sizing screens. Thus, they must be removed for repair or replacement. In addition, they are changed out to modify the quality of the resulting ground material when being used for varying applications.

In some materials there is a possibility that the material will be wrapped around the grinding drum, between the hammers or cutters, and eventually pinched between the drum and the sizing screens. In this condition there may be sufficient drag on the drum to stall it. In this situation it is necessary to gain access to the drum to remove the wrapped material.

SUMMARY OF THE INVENTION

The present disclosure includes examples of inventive aspects adapted for facilitating providing access to the sizing screen of a grinder. The present disclosure also includes examples of methods for installing and removing sizing screens. Examples of a variety of inventive aspects are set forth in the description that follows. It is to be understood that the foregoing general description and the following detailed description are exemplary and explanatory only, and are not restrictive of the broad inventive aspects disclosed herein.

DETAILED DESCRIPTION

Figure 1:
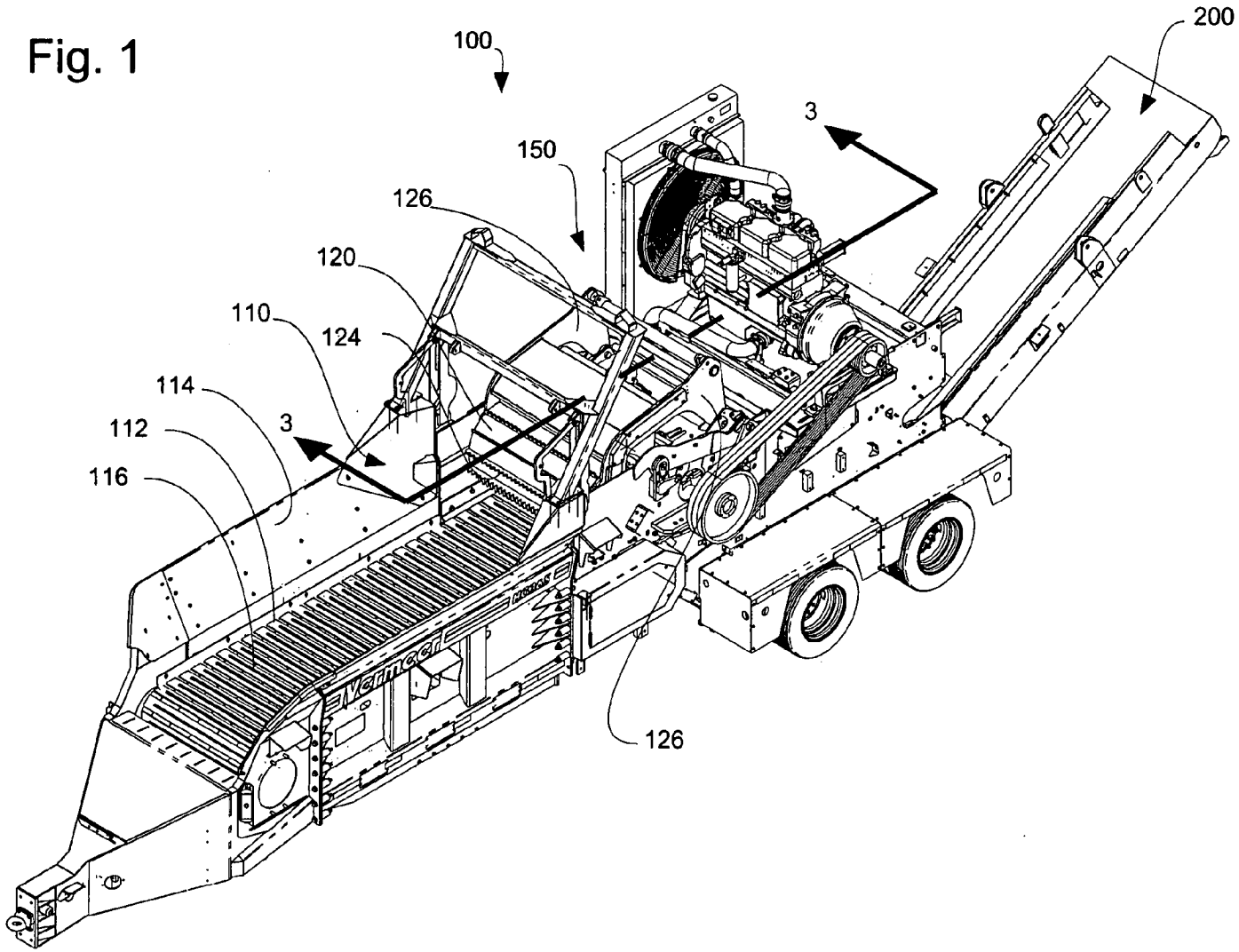
FIG. 1 is a perspective view of a materials grinder having features that are examples of inventive aspects in accordance with the present disclosure.

Referring to the drawings, and in particular to FIG. 1, a materials grinder 100 is illustrated that includes features that are examples of inventive aspects in accordance with the present disclosure. This materials grinder is of the type known as a horizontal grinder and includes a feed hopper 110 for supporting a wide variety of materials. The grinder 100 is capable of holding loose materials such as leaves, shingles, small branches and also capable of holding larger objects such as large branches, boards, planks. A feed table 112, in cooperation with side panels 114, provides this capability.

The materials loaded into the feed hopper 110 are propelled towards a mill box 150 by conveyor bars 116 that are attached to conveyor chain 117. Conveyor chain is routed around conveyor sprockets 119 that are mounted onto conveyor roller shafts 118. One of the conveyor roller shafts 118 is powered, typically by a hydraulic motor in a manner that allows the conveyor bars to be propelled in either direction.

As the material is propelled towards the grinding drum, it will contact feed roller 120. Feed roller 120 is mounted on a feed roller shaft 122 that is supported on mount arms 126. The feed roller 120 is driven by a hydraulic motor, and typically includes feed bars 124. The feed bars engage the material to be ground tending to keep it on top of the material and providing additional feed pressure on the material, urging it towards the mill box 150 which will contact the material and grind it to a desired size.

Ground material will exit mill box 150 and fall onto a discharge conveyor 200 that will transport it to a position beside the materials grinder 100.

Figure 2:
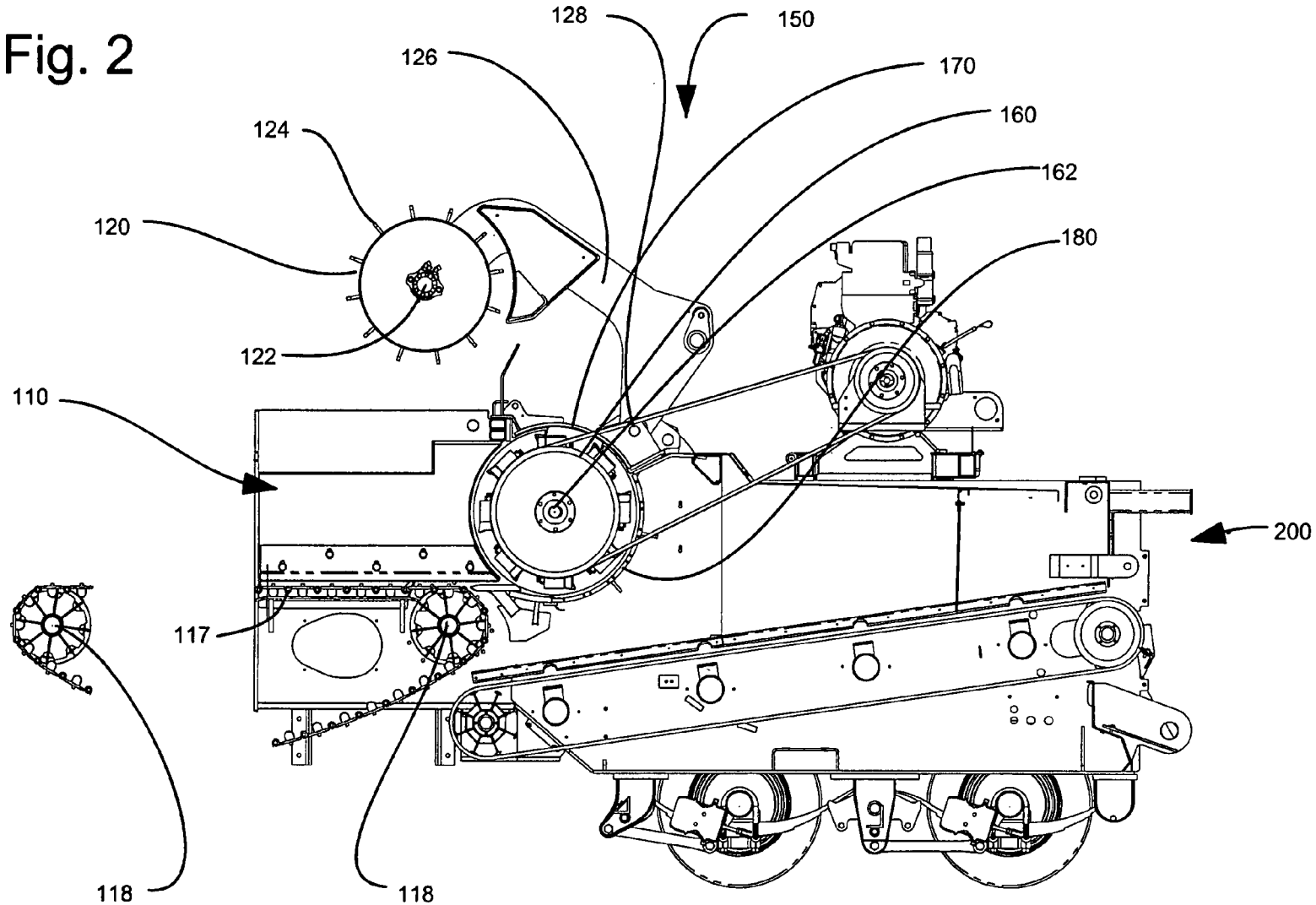
FIG. 2 is a schematic, partial side elevation view of the grinder shown in FIG. 1.

FIG. 2 illustrates the mill box 150 area in more detail. The mill box 150 includes a grinding drum 160 mounted on drum shaft 162, a sizing screen 180 and top cover 170. The sizing screen 180 extends below the drum 160. The top cover 170 is positioned directly above the grinding drum 160 as further illustrated in FIG. 3. It serves to hold material that is being ground from being thrown from the machine and provides pivotal support for the feed roller mount arms 126 at pivot points 128.

Figure 3:
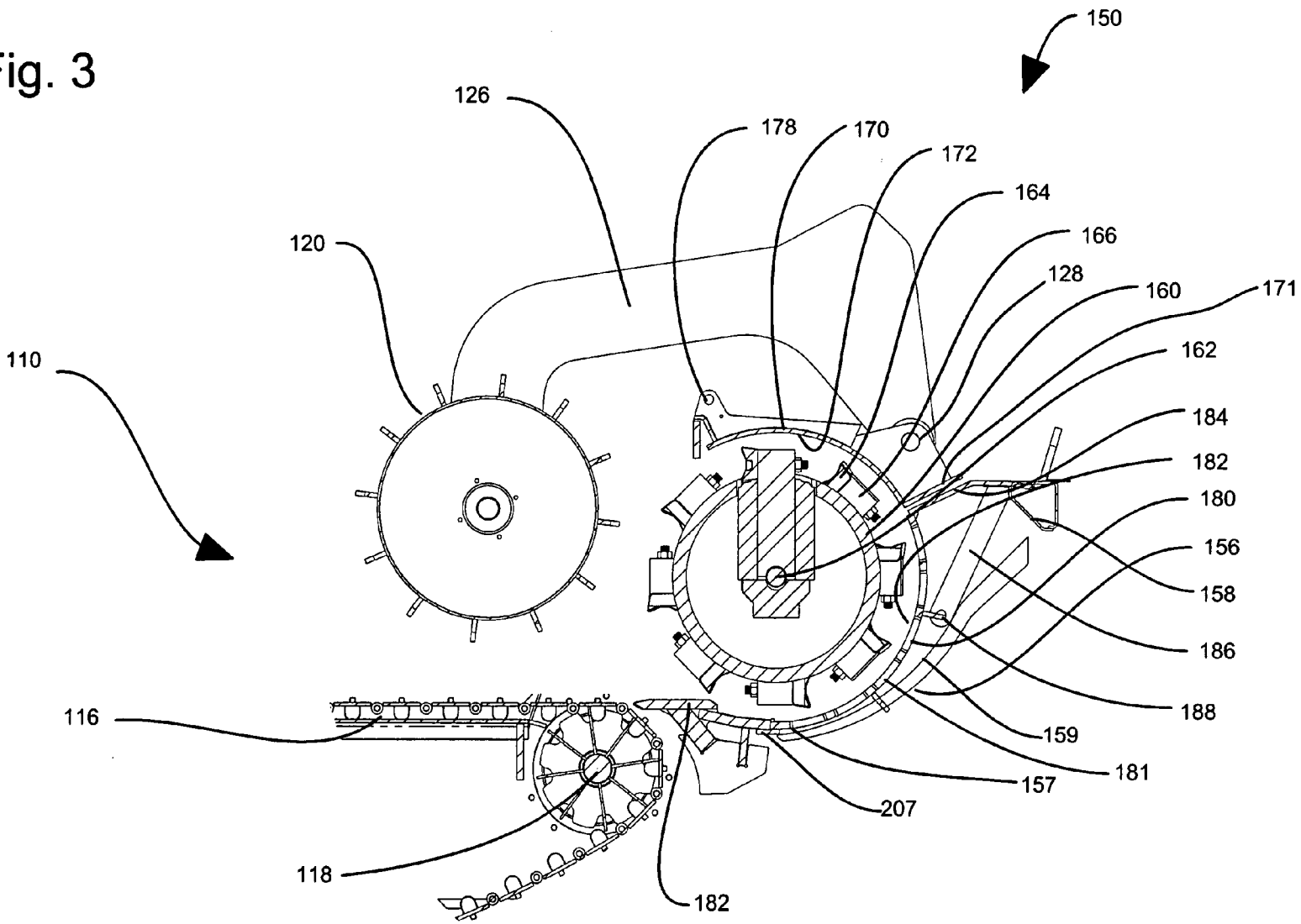
FIG. 3 is a cross section taken along line 3—3 as illustrated in FIG. 1.

The operating positioning of the components of the mill box is illustrated in FIG. 3. The feed hopper 110 retains the material to be ground while the conveyor bars 116 propel it towards the mill box 150. As it nears the mill box 150 feed roller 120 will contact the top portion of the material to be ground and assist in forcing it into contact with the grinding drum 160 which is being rotated about drum shaft 162. An example of a grinding drum can be seen in U.S. Pat. No. 6,422,495, herein incorporated by reference, including cutters 164 mounted on hammers 166. Many different styles of grinding drums are available. The cutters 164 will contact the material and drive it down, towards an anvil 182. The initial impact of the cutters 164 will cause the material to be partially ground. Further impact and shearing forces will be applied as the material passes between the anvil 182 and the grinding drum 160. The clearance between the outer swing diameter of the cutters 164 and the anvil 182 will affect the size of the ground material, and the anvil is typically located close to this outer swing diameter.

Once the material passes the anvil it is trapped between an inner surface 182 of the sizing screen 180 and the drum 160. There it may pass through a hole in the sizing screen 180 and be ejected from the mill box 150. Bigger pieces may become partially engaged with a hole in the sizing screen 180 and then subsequently impacted again by a cutter 164 causing them to be reduced in size to fit through the holes and be ejected. Other larger particles may be carried around the inside surface 182 of the sizing screen 180, the inside surface 172 of the top cover 170, and carried back to the feed hopper 110.

The inner surface 182 preferably defines a curvature of constant radius that is centered about the axis of rotation of the drum 160. The clearance between the inner surface 182 of the sizing screen and the hammers, and the size and configuration of the holes in the sizing screen 180 will affect the performance. Changing these parameters will affect the quality of the ground material as required by the variety of applications. In addition, when grinding some products, they will tend to wrap around the drum 160 rather than being ground, and can wrap sufficiently to prevent free rotation of the grinding drum 160. In this case it may be necessary to interrupt operation, to relieve the pressure on the wrapped material, and to remove it prior to resuming operation.

Figure 4C:
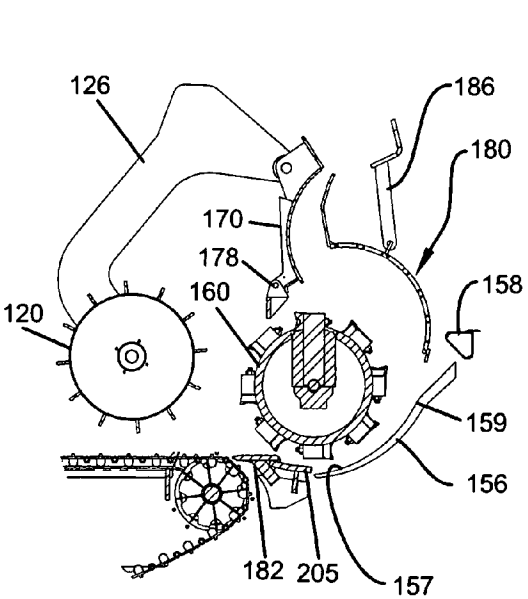
FIG. 4*c* is the same view as seen in FIG. 3 with the cover in the open position and the sizing screen fully removed.
Figure 4B:
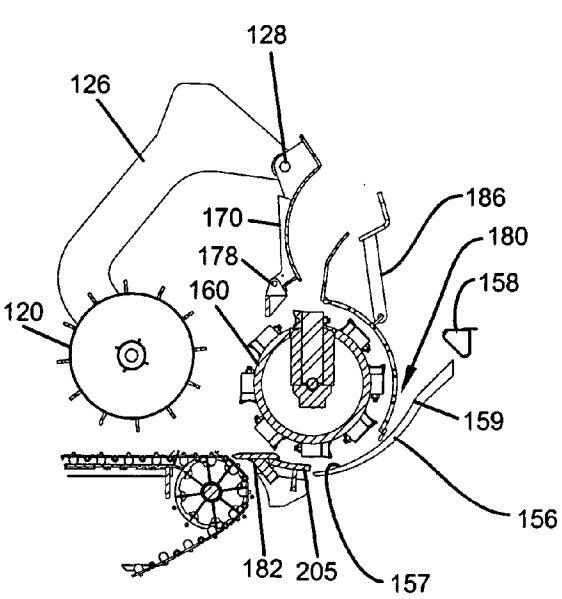
FIG. 4*b* is the same view as seen in FIG. 3 with the cover in the open position and the sizing screen ½ removed.
Figure 4A:
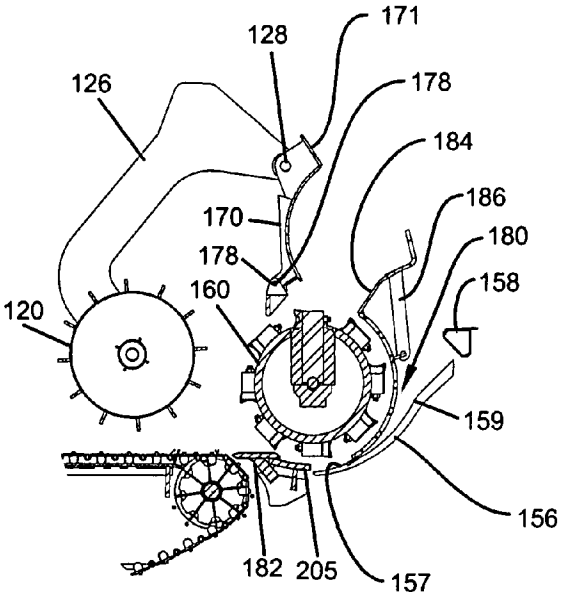
FIG. 4*a* is the same view as seen in FIG. 3 with the cover in the open position and the sizing screen ¼ removed.
Figure 7:
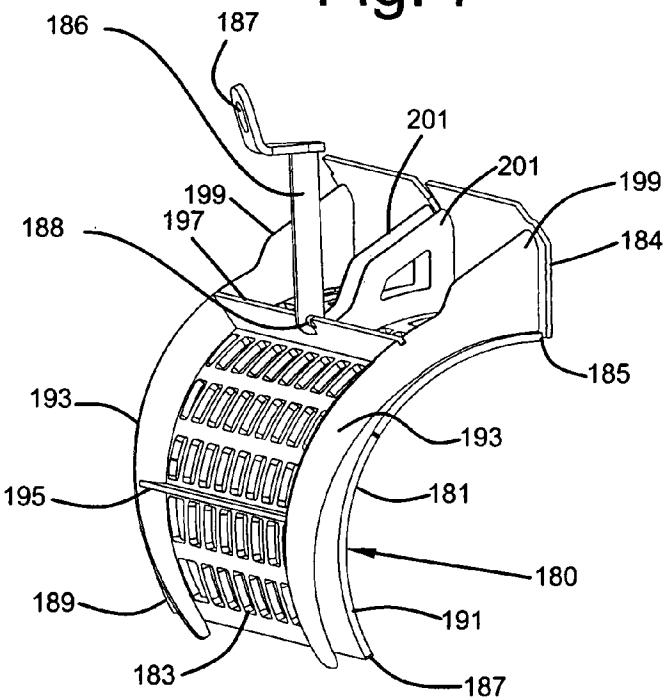
FIG. 7 is an isometric view showing the sizing screen in the removed position, as suspended by the lifting bar.

The mill box of the present invention provides enhanced access capabilities as illustrated in FIGS. 4*a*, 4*b* and 4*c*. FIG. 4*a* illustrates the top cover 170 pivoted about pivot point 178 into an open position. In this position an operator is able to gain access to the grinding drum 160 to clear any obstacles. It is also possible to attach a lifting device (e.g., a crane or hoist) to a lift member such as a lift bar 186 of the sizing screen 180 in order to lift the sizing screen out of the mill box. As shown in FIG. 7, the lift bar 186 can include an eyelet 187 or other type of structure for receiving a hook, chain or other component of a lifting device. FIGS. 4*b* and 4*c* illustrate the sizing screen and lift bar as they are further removed from the mill box, to the position illustrated in FIG. 4*c*, where the sizing screen is completely removed.

Figure 5A:
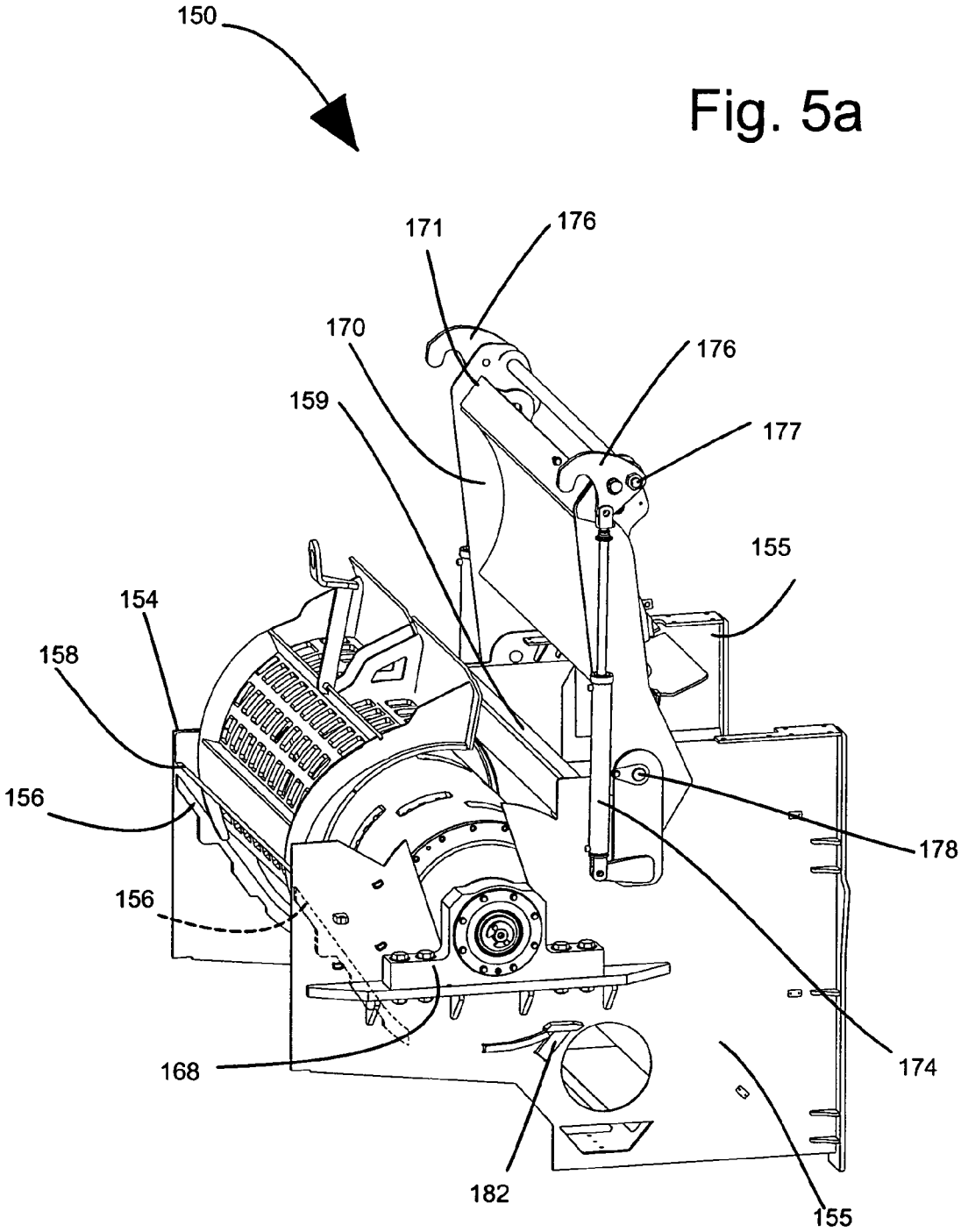
FIG. 5*a* is a perspective view of a mill box of the horizontal grinder of FIG. 1, the mill box is shown in the open position with the sizing screen in a partially removed position.

The first step of the removal process is to pivot the top cover into the open position of FIG. 4*a*. This step is enabled by cylinder 174, as illustrated in FIG. 5*a* with the top cover in its open position. This figure illustrates the top cover 170 in the open position where the cylinder 174 has been extended. The initial extension of cylinder 174 will rotate latch 176 around latch pivot 177 to disengage from latch pin 152 (shown in FIG. 5*b* where the cover is closed). Additional extension of cylinder 174 will rotate top cover 170 around pivot 178 to the open position illustrated. In this position any material that had been trapped between the drum 160 and the top cover 170 will be released and an operator can gain access to the grinding drum 160 to remove wrapped material.

Figure 5B:
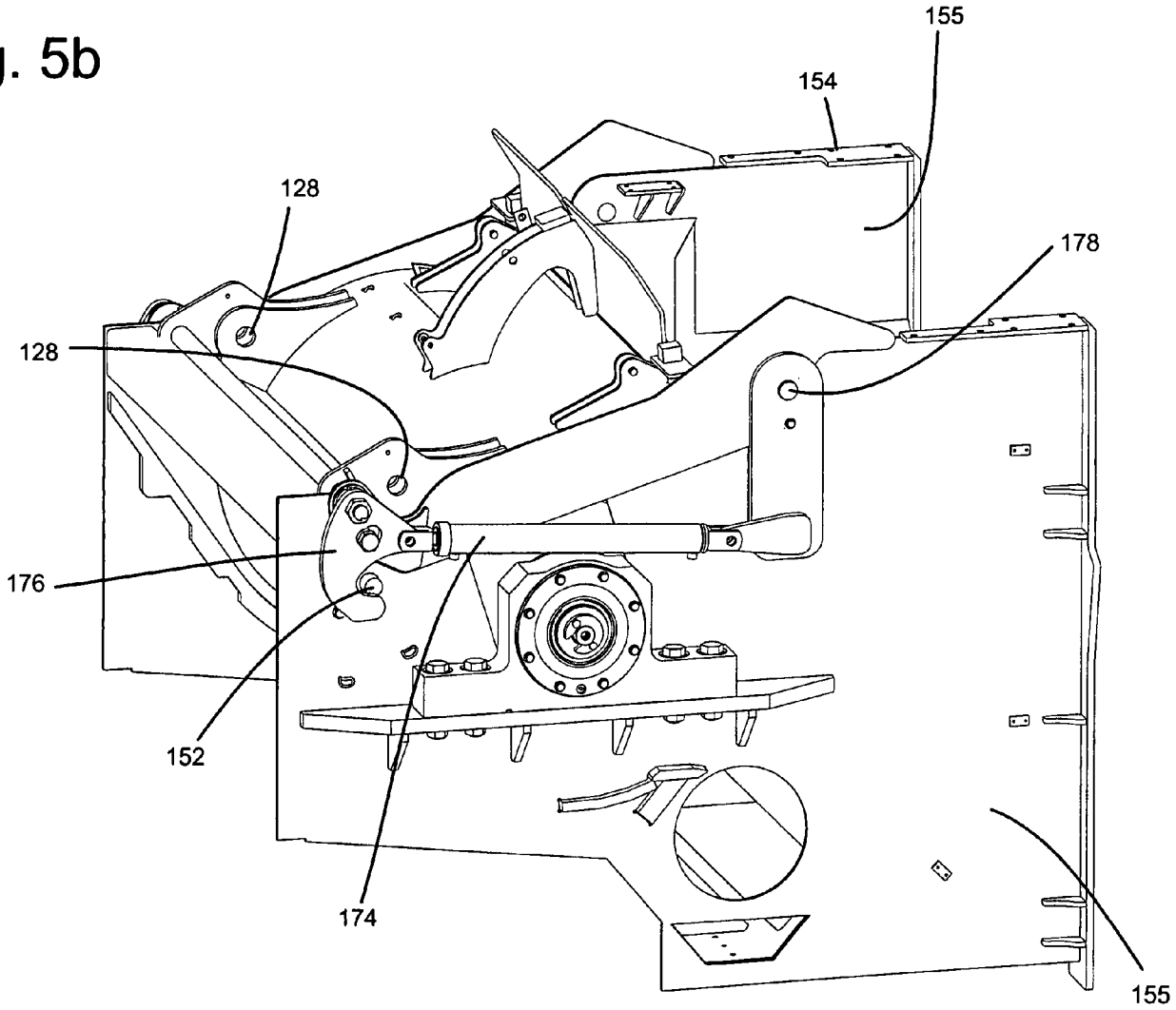
FIG. 5*b* is a perspective view of the mill box of FIG. 5*a* in a closed position.

In the normal operating position of the mill box, illustrated in FIG. 5*b*, the top cover 170 will be in the closed position where cylinder 174 is retracted and has pulled latch 176 into engagement with latch pin 152. Latch pin 152 is secured to mill box frame 154, which is comprised of two sides 155 and cross members 158, 159 and anvil 182. The mill box frame also provides support for the top cover pivot 178, grinding drum bearings 168 and a pair of sizing screen slides 156 (i.e., guides or tracks as shown in FIG. 5*a*). In the closed configuration, with the latch 176 engaged with the latch pin 152, the forces of the grinding action, occurring between the cutters 164, the sizing screens, and top cover 150, are retained within the structural component defined by the mill box frame 154.

Referring to FIG. 7, the sizing screen 180 includes a sizing plate 181 defining a plurality of sizing openings 183. The plate 181 (i.e., one or more plates) has an upper end 185 and a lower end 187. Edges 189, 191 of the plate 181 extend between the upper and lower ends 185, 187. Curved reinforcing flanges 193 are secured to the outer side of the plate 181 and extend generally along the edges 189, 191. Cross-braces 195, 197 extend between the flanges 193. A top plate 184 extends outwards from the upper end 185 of the plate 181. The top plate 184 is reinforced by enlargements 199 of the flanges 193, as well as a pair of reinforcing plates 201 that extend between brace 197 and the top plate 184.

Referring to FIG. 5*a*, the slides 156 are connected (e.g., welded or fastened) to opposite side walls 155 of the mill box. As shown schematically in FIGS. 4*a*–4*c*, the slides 156 have a curvature that curves about the axis of rotation of the drum 160. The slides 156 are oriented such that lower regions 157 of the slides are positioned closer to the axis of rotation of the drum 160 than upper regions 159. As shown in FIG. 3, the mill box also includes a stop 205 positioned adjacent the anvil 182. The stop 205 is adapted to abut against the lower end 187 of the sizing plate 181.

Referring still to FIG. 3, an end plate 207 projects outwardly from the lower end 187 of the sizing plate 181. The end plate 207 underlaps the stop 205 to prevent the lower end 187 of the sizing plate 181 from flexing inwardly.

In this normal operating position, as illustrated in FIG. 3, a flange 171 of the top cover 170 opposes the top plate 184 of the sizing screen 180, trapping and holding the top plate 184 in position. With the top cover in the open position, there are no retainers holding the sizing screen in position. It is, at that time held in position by slides 156 and cross member 158 of the mill box frame 154. For example, the top plate 184 seats on cross-member 158, the edges 189, 191 of the sizing plate 181 seat on the lower regions 157 of the slides 156, and the lower end 187 of the sizing plate 181 abuts against the stop 205 of the mill box.

Figure 6:
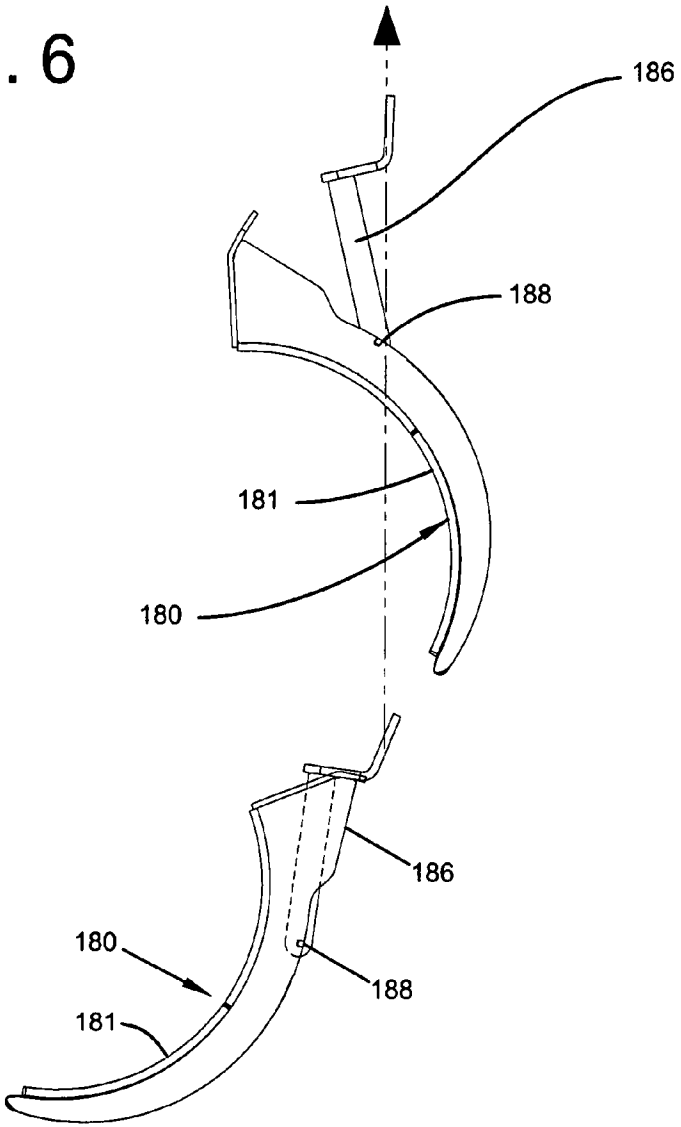
FIG. 6 is a side view of a sizing screen of the grinder of FIG. 1 shown in the installed orientation and in the removed orientation.

To remove the sizing screen 180 a lifting device, not shown, is attached to the lifting bar 186 in order to lift it out of the mill box frame 154, as shown in FIGS. 6 and 7. As the sizing screen 180 is lifted it will tend to follow the slides 156, rotating around the centerline of the grinding drum 160, as the slides 156 are arcuate and extend generally along an exterior of the drum 160. Lift bar 186 is pivotally attached to the sizing screen 180 at a pivot point 188 that is positioned such that when removed, the sizing screen will be moved by gravity to the orientation illustrated in the upper position of FIG. 6. In this manner the lift mechanism can operate to provide a nearly straight lift, and the sizing screen will be removed in a manner that makes it easy for an operator to control.

Likewise for installation, the sizing screen 180, when lifted by the lift bar 186, will be in the correct orientation to begin to engage with slides 156. The installation process will then include first lifting the sizing screen into position so that its lower end 187 engages the slides 156. The sizing screen is then lowered. As it is lowered it will rotate around pivot point 188 as the screen rides downwardly along the slides 156. As the sizing screen moves downwardly along the slides 156, the sizing screen is gradually moved into its final position in close proximity to the drum 160 by the lower regions 157 of the slides 156. In other words, the transition from the upper regions 159 of the slides to the lower regions 157 of the slides causes the sizing screen 180 to move gradually towards the drum 160 to its final position in close concentric proximity to the drum 160. After it has been completely lowered, the back surface of the lift bar 186 will be resting against cross member 158, and the lift bar 186 is positioned between the reinforcing plates 201 of the sizing screen 180. Once the screen 180 is fully lowered, the lifting device will be detached from the lift bar 186. The top cover will then be closed, resulting in flange 171 contacting top plate 184, trapping the sizing screen in place. Sizing screen 180 is then held in place by the lower portions 157 of slides 156, the cross member 158 and the stop 205. The cylinder 174 will then fully retract and latch 176 will reengage latch pin 152.

In this manner the present invention provides a mill box that allows the operator to quickly and conveniently gain access to the grinding drum to release pressure of wrapped material and clean out wrapped material. It also provides for a quick and convenient method to remove, and exchange or repair the sizing screens.

The above specification, examples and data provide a complete description of the manufacture and use of the composition of the invention. While a preferred embodiment of the present invention relates to horizontal grinders, it will be appreciated that the various inventive aspects are also applicable to other types of grinder configurations. Since many embodiments of the invention can be made without departing from the spirit and scope of the invention, the invention resides in the claims hereinafter appended.

We claim:

1. A materials grinder comprising:

a horizontal feed table;

a feed roller mounted on support arms;

a grinding drum;

a top cover for the grinding drum;

wherein the top cover includes first and second pivoting connections, the first pivoting connection providing pivotal support for the top cover, the second pivoting connection providing pivotal support for the support arms.

2. The grinder of claim 1, wherein the top cover is configured to pivot from a closed position to an open position, about the first pivotal support, to provide access to the grinding drum.

3. The grinder of claim 2, wherein the support arms and the feed roller move in relation with the top cover when the top cover is pivoted from the closed position to the open position.

4. The grinder of claim 1, wherein the top cover pivots in a counterclockwise direction when the top cover is pivoted from a closed position to an open position.

5. The grinder of claim 4, wherein the support arms pivot in a clockwise direction when the support arms are pivoted from a lowered position to a raised position.

6. The grinder of claim 1, wherein the top cover has a first end and a second end, the first end being located adjacent to the feed roller, and wherein the second pivoting connection providing pivotal support for the support arms is located adjacent to the second end of the top cover.

7. A material grinder comprising:

a horizontal feed table having a first end and a second end;

a mill box located adjacent to the second end of the feed table, the mill box including:

a mill box frame;

a grinding drum mounted to the mill box frame;

a sizing screen spaced apart from the grinding drum; and a top cover connected to the mill box frame at a first pivot connection; and a feed roller mounted to a support arm, the support arm being connected to the top cover at a second pivot connection.

8. The grinder of claim 7, wherein the top cover is configured to pivot from a closed position to an open position to provide access to the grinding drum.

9. The grinder of claim 7, wherein the top cover pivots about a first pivot axis to provide access to the grinding drum, and wherein the support arms pivot about a second pivot axis different from the first pivot axis.

10. The grinder of claim 7, wherein the top cover has a first end and a second end, the first pivot connection being located adjacent to the first end of the top cover, the second pivot connection being located adjacent to the second end of the top cover.

11. The grinder of claim 10, wherein the second end of the top cover pivots in a counterclockwise direction, about the first pivot connection, to provide an access opening adjacent to the grinding drum.

12. A method of accessing a mill box region of a materials grinder, the method comprising the steps of:

providing a mill box including a mill box frame, a grinding drum mounted to the mill box frame, a sizing screen spaced apart from the grinding drum, and a top cover;

pivoting a support arm having a feed roller to a first position about a support arm axis, the support arm being interconnected to the top cover at the support arm axis; and pivoting the top cover of the mill box to an open position about a top cover axis;

wherein pivoting the top cover to the open position provides an opening adjacent to the grinding drum for access to an inner region of the mill box.

13. The method of claim 12, further including lifting the sizing screen through the opening of the mill box when the top cover is in the open position.

* * * * *